US006955000B2

(12) United States Patent
Pawlik et al.

(10) Patent No.: US 6,955,000 B2
(45) Date of Patent: Oct. 18, 2005

(54) LABELING APPARATUS AND METHOD OF MAKING SAME

(75) Inventors: Christopher A. Pawlik, Malvern, PA (US); David C. Diemer, Collegeville, PA (US)

(73) Assignee: National Label Company, Lafayette Hill, PA (US)

( * ) Notice: Subject to any disclaimer, the term of this patent is extended or adjusted under 35 U.S.C. 154(b) by 0 days.

(21) Appl. No.: 10/692,467

(22) Filed: Oct. 23, 2003

(65) Prior Publication Data

US 2004/0177535 A1 Sep. 16, 2004

Related U.S. Application Data

(60) Provisional application No. 60/421,232, filed on Oct. 25, 2002.

(51) Int. Cl.[7] ..... G09F 3/00
(52) U.S. Cl. ..... 40/310; 40/638; 283/81
(58) Field of Search ..... 40/310, 306, 638; 283/81

(56) References Cited

U.S. PATENT DOCUMENTS

| | | | | | |
|---|---|---|---|---|---|
| 3,733,002 | A | * | 5/1973 | Fujio | 40/310 |
| 3,750,317 | A | * | 8/1973 | Morgan | 40/310 |
| 5,605,230 | A | * | 2/1997 | Marino et al. | 40/310 |
| 2003/0061750 | A1 | * | 4/2003 | Bernier et al. | 40/310 |

* cited by examiner

*Primary Examiner*—Gary C. Hoge
(74) *Attorney, Agent, or Firm*—Reed Smith LLP

(57) ABSTRACT

A unitary labeling apparatus for a container having a cap secured over an opening to an interior hollow, the apparatus including: a non-shrinkable base label suitable for being secured about a periphery of the container and to a portion of the cap; and, a shrinkable overlayer secured to the base label and suitable for being shrunk about the periphery of the container and a periphery of the cap; wherein, the unitary labeling apparatus is suitable for evidencing accessing of the container interior hollow via removal of the cap once secured about the container.

20 Claims, 11 Drawing Sheets

LABELING APPARATUS AND METHOD OF MAKING SAME

RELATED APPLICATION

This application claims priority of U.S. Patent Application Ser. No. 60/421,232, filed Oct. 25, 2002, entitled "LABELING APPARATUS", the entire disclosure of which is hereby incorporated by reference as if being set forth in its entirety herein.

FIELD OF THE INVENTION

The present invention relates in general to labels and, more particularly, to labels for products and product containers.

BACKGROUND OF THE INVENTION

With an increasing interest in "out of package" containers, a need has arisen for a cost effective solution to address both labeling and tamper evidencing needs. Currently in many packaging operations a container is labeled with a pressure sensitive label, and then a separate clear shrinkable polyvinyl-chloride (PVC) shrink sleeve is applied as a "safety seal" tamper evidencing feature.

SUMMARY OF THE INVENTION

A unitary labeling apparatus for a container having a cap secured over an opening to an interior hollow, the apparatus including: a non-shrinkable base label suitable for being secured about a periphery of the container and to a portion of the cap; and, a shrinkable overlayer secured to the base label and suitable for being shrunk about the periphery of the container and a periphery of the cap; wherein, the unitary labeling apparatus is suitable for evidencing accessing of the container interior hollow via removal of the cap once secured about the container.

BRIEF DESCRIPTION OF THE FIGURES

Understanding of the present invention will be facilitated by consideration of the following detailed description of the preferred embodiments of the present invention taken in conjunction with the accompanying drawings, in which like references refer to like parts, and.

DETAILED DESCRIPTION OF THE PREFERRED EMBODIMENTS

It is to be understood that the figures and descriptions of the present invention have been simplified to illustrate elements that are relevant for a clear understanding of the present invention, while eliminating, for purposes of clarity, many other elements found in conventional labels and label manufacturing methods. Those of ordinary skill in the art will recognize that other elements are desirable and/or required in order to implement the present invention. However, because such elements are well known in the art, and because they do not facilitate a better understanding of the present invention, a discussion of such elements is not provided herein. The disclosure herein is directed to all such variations and modifications to such systems and methods known to those skilled in the art.

According to an aspect of the present invention, a label apparatus may incorporate two labeling items in a cost effective manner. According to an aspect of the present invention, a standard pressure sensitive label may be used, which is then permanently laminated with a clear shrinkable PVC overlayer that may act as the "safety seal" feature. This construction results in a single or unitary label, that may be applied and shrunk in one step, utilizing conventional materials and thus providing a comparable degree of tamper evidencing as a separate shrink sleeve.

According to an aspect of the present invention, the labeling apparatus of the present invention may be formed using two dies. The first die may be used to undercut the base label material. An unsupported PVC lamination (or PVC material including no adhesive) may then be applied to the base label using a suitable adhesive. Of course, a supported PVC lamination (or PVC material including an adhesive material) may be used with appropriate deadening techniques. A second die may then be used to add perforations and form the finished label.

According to an aspect of the present invention, such a label apparatus may also provide for a "peel tab" which pulls down from the cap of the container to which the label is applied, to allow at least a portion of the PVC overlayer to be removed from the cap via a perforation around the perimeter of a neck of the bottle and access to the bottle interior. Such a label apparatus may also provide for a paper base label with an aggressive permanent adhesive that may destruct, or substantially destruct, upon removal providing a further degree of tamper evidencing.

Figure 1:
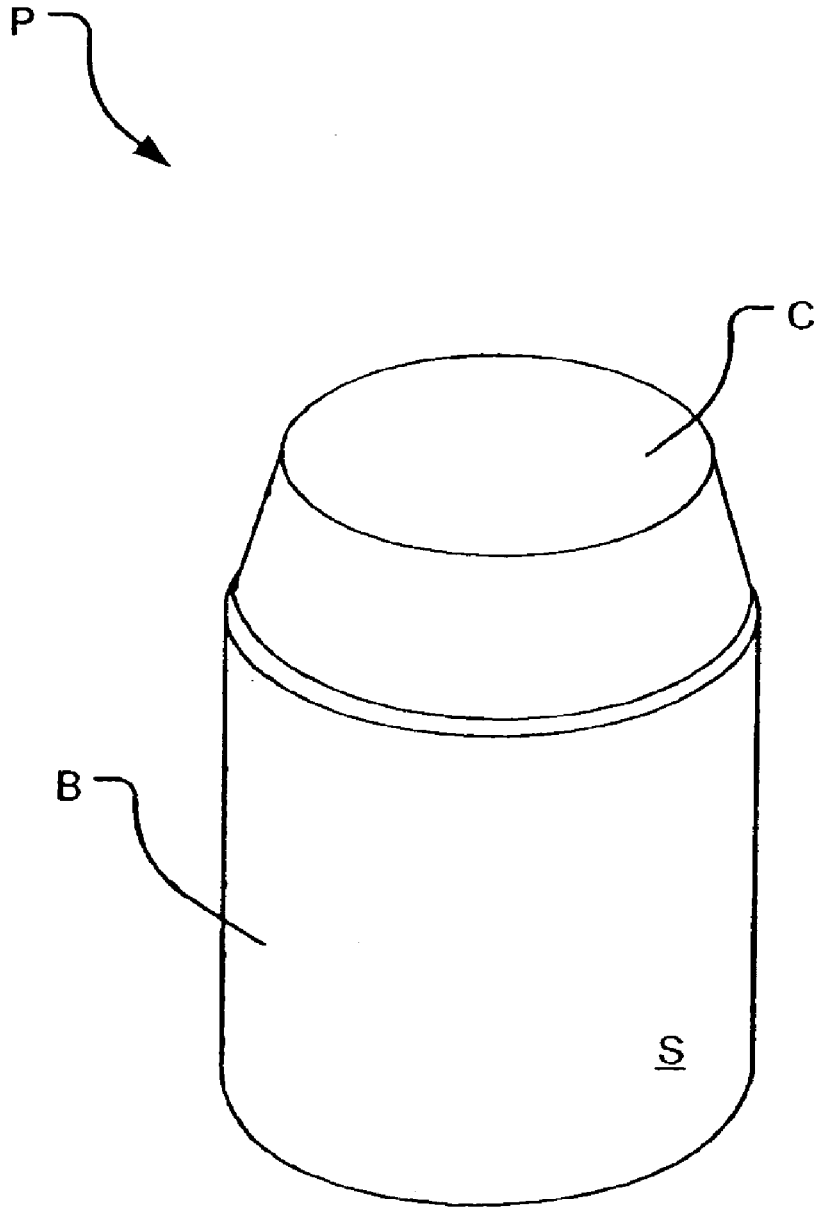
FIGS. 1–3 illustrate exemplary containers that may be labeled according to an aspect of the present invention.

Referring now to FIG. 1, there is shown an object to be labeled in the form of a product container P, e.g., a bottle, jar, or the like. Container P generally includes a substantially hollow body B and cap C. As is conventionally understood, cap C may secure about a neck of body B and provide access to an interior hollow of body B. Cap C and/or bottle B may include "child-proof" features as is understood by those possessing an ordinary skill in the pertinent arts. By way of non-limiting example, cap C may include one or more depressible tabs, which when activated allow cap C to unscrew or uncouple from body B as is conventionally understood.

Body B includes an outer surface S formed by a sidewall thereof. As used herein, the terms "circumferential," "circumference," or variants thereof shall be construed to include any distance circumscribing the perimeter of the target object to be labeled. The object may comprise a polygonal shape (e.g., square or rectangular), curvilinear shape (e.g., circular or oval) or composite polygonal and curvilinear cross-sectional configuration defining a desired perimetrical exterior wall surface.

In the particular case of FIG. 1, body B is seen to be substantially cylindrical while cap C is seen to take a substantially conical shape. Cap C may be seen to taper from a widest portion near body B to a narrowest portion distal from body B.

The present invention will be further described in connection with the container P of FIG. 1 for non-limiting and exemplary purposes only. However, it should be understood that the present invention is well suited for use with a variety of container, or object, shapes. Referring now also FIGS. 2 and 3, there are shown other non-limiting examples of containers P suitable for use with the present invention.

Figure 4:
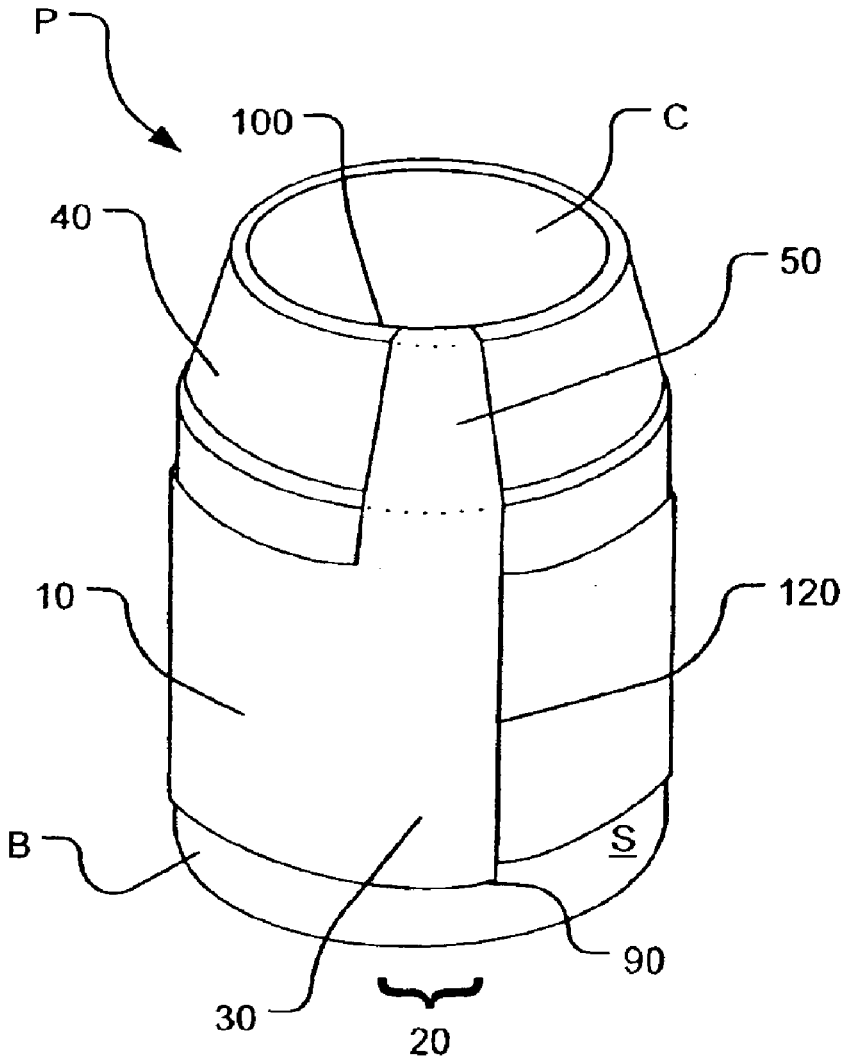
FIG. 4 illustrates the container of FIG. 1 having a label according to an aspect of the present invention fixed thereabout.

Referring now also to FIG. 4, adhesively affixed about the circumferential surface S of container P is a wrap-type labeling apparatus or label 10. Label 10 may cover any fraction of the circumferential side wall surface S of container P. As illustrated, label 10 is constructed as an elongated strip member spanning approximately the entire circumference of container P such that the ends of the label overlap by a relatively small region 20 as compared to the entire length of the label 10.

Figure 5:
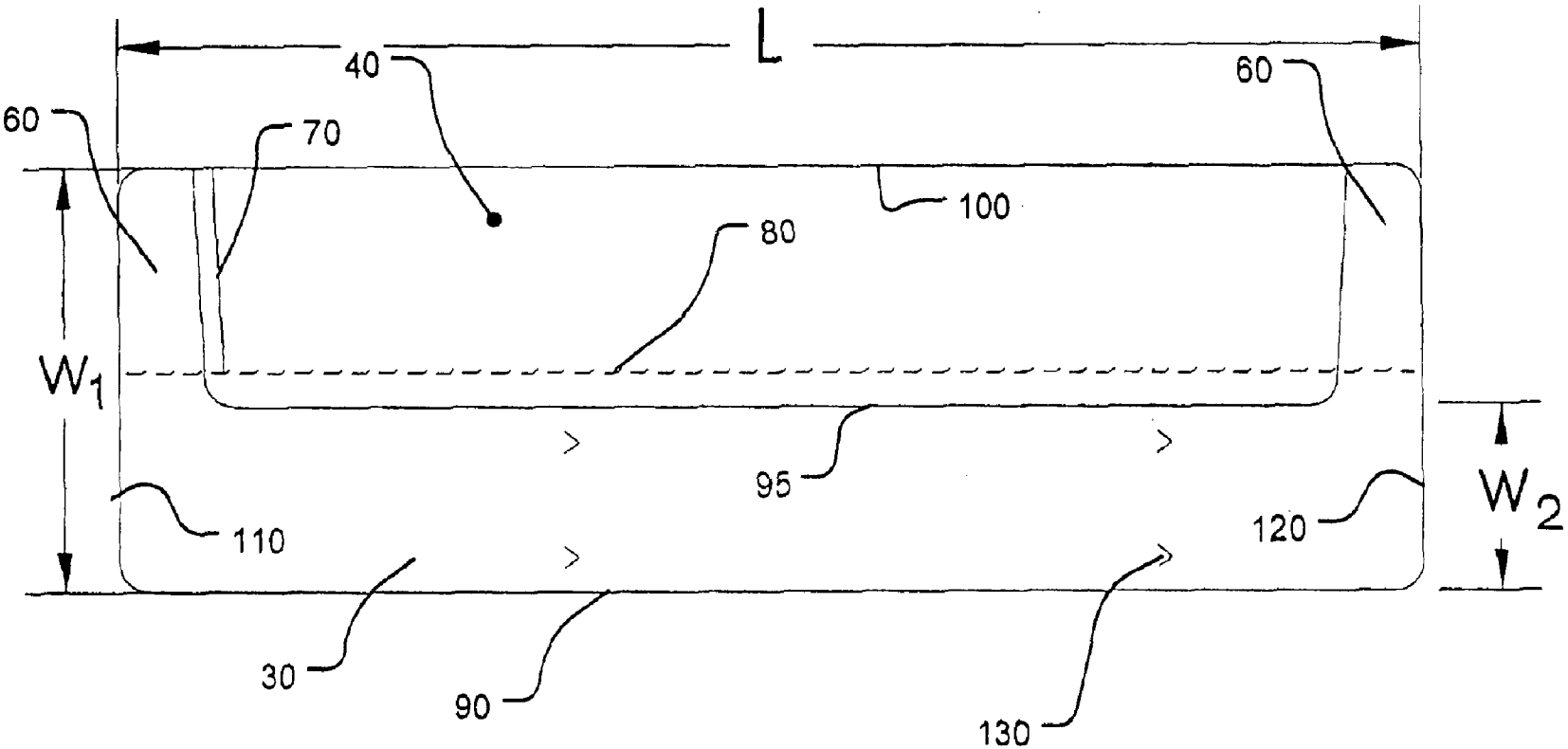
FIG. 5 illustrates a plan view of a label suitable for use as the label of FIG. 4.

Referring now to FIGS. 4 and 5, label 10 may generally be seen to have a length L and width $W_1$. Label 10 may generally include a base label 30 and overlayer 40. Base label 30 may generally be seen to have length L, width $W_2$, and portions 60 laterally projecting to width $W_1$. Layer 40 may generally be seen to have length L and width $W_1$. Layers 30 and 40 may collectively form label 10, such as by being laminated together.

According to an aspect of the present invention: length L may be approximately 5 ⅞ inches; $W_1$ may be approximately 2⅛ inches; and $W_2$ may be approximately 13/16 inches.

Base label 30 may take the form of a flexible substrate such as a paper or plastic (such as, for example, polyvinyl chloride or polyethylene) sheet or other suitable web material. Such a substrate may have a pressure sensitive adhesive (PSA) disposed on an underside coupling the substrate to a release liner to better enable processing of substrate 30 until label 10 is to be applied to container P. Base label 30 may be clear. Base label 30 may be substantially transparent or translucent. Base label 30 may be tinted. Base label 30 may be substantially opaque. Base label 30 may include indicia. Such indicia may be printed on an oppositely disposed surface from the PSA.

Overlayer 40 may take the form of a flexible plastic sheet (such as, for example, a shrinkable PVC material, polyethylene, PETG, OPS, polypropylene, polyolefin, polystyrene, or polyester, to name a few non-limiting examples). Layer 40 is preferably compatible with labeling processes and is labeling machine shrinkable. Layer 40 may be clear. Layer 40 may be substantially transparent or translucent. Layer 40 may be tinted. Layer 40 may be substantially opaque. Layer 40 may include indicia associated with container P, or the security of the hollow thereof, printed thereon. For example, such indicia may be reverse printed on layer 40. Of course, depending upon design criteria such indicia may be direct printed on layer 40 as well. In other words, printed indicia may be either surface or subsurface printed as is understood in the pertinent arts.

According to an aspect of the present invention, base label 30 may be formed of UA41AG commercially available through Acucote, of Graham, N.C., while overlayer 40 may be formed of product Genotherm GE 15, commercially available through Kalle Pentaplast of Holland. According to an aspect of the present invention, layer 40 may be approximately 15–50 microns thick.

The PSA of base label 30 may be suitable for securing label 10 about the circumference of container P, such as by adhering to surface S. Layer 40 may be shrunk about container P, using heat for example, so as to at least partially envelop cap C in such a way as to provide evidencing for potential tampering of product or material contained within the hollow of body B prior to consumption thereof by an end user. Of course, container P may contain any material suitable for being packaged therein, or no material at all, for example.

Label 10 generally includes longitudinally extending edges 90, 100 and laterally extending ends 110, 120. Label 10 may include one or more extending portions 50. Portions 50 may include laterally extending portions 60 of base label 30. Laterally extending portions 60 may also be overlaminated with layer 40 to form portions 50. According to an aspect of the present invention, extending portions 50 may be disposed at or near ends 110, 120 of label 10. At least one of portions 60 may be secured to cap C via the PSA of base label 30. At least one other of the portions 60 may adhere to another portion 50 via the PSA of base label 30. Perforations 70 may be provided in layer 40 approximate to portions 60. Perforations 80 may be provided in layer 40 approximate to a portion of an internal edge 95 of label 30, e.g. running along and at approximately distance $W_2$ from an edge 90 of label 10. In this way, upon application of label 10 to container P as is shown in FIG. 4, portions 50 may form a tear strip for removing at least a portion of layer 40 of label 10 at least partially enveloping cap C. Optionally, perforations 80 may be provided in both layer 40 and base label 30 approximate to portions 60 in order to further facilitate complete removal of extending portions 50.

Base label 30 and/or layer 40 may include one or more perforations 130 for facilitating substantial destruction of label 10 upon attempted removal thereof from a container P once applied thereto.

Figure 6:
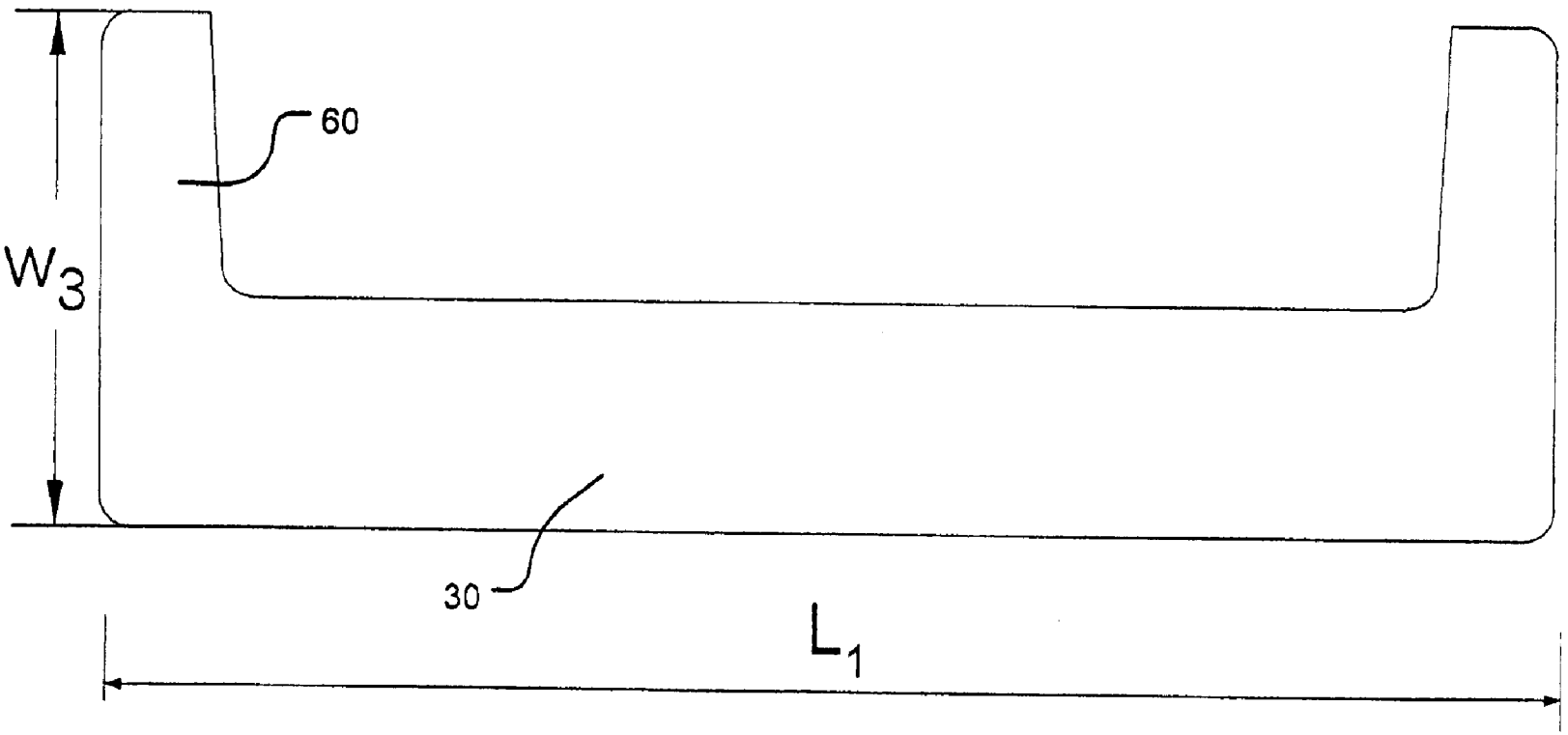
FIG. 6 illustrates a base label suitable for use with the label of FIG. 5.

Referring now to FIG. 6, there is shown a base label 30 suitable for use with the label 10 of FIGS. 4 and 5. Base label 30, prior to lamination with layer 40, may generally be seen to have a length $L_1$ somewhat greater than length L of FIG. 5, and a width $W_3$ somewhat greater than width $W_2$ of FIG. 5, and laterally projecting portions 60. For example, $W_3$ may be approximately 2⅛ inches and compared to $W_1$ being about 1⅞ inches. Optionally, base label 30 may also include perforations 80 and 130.

Figure 7:
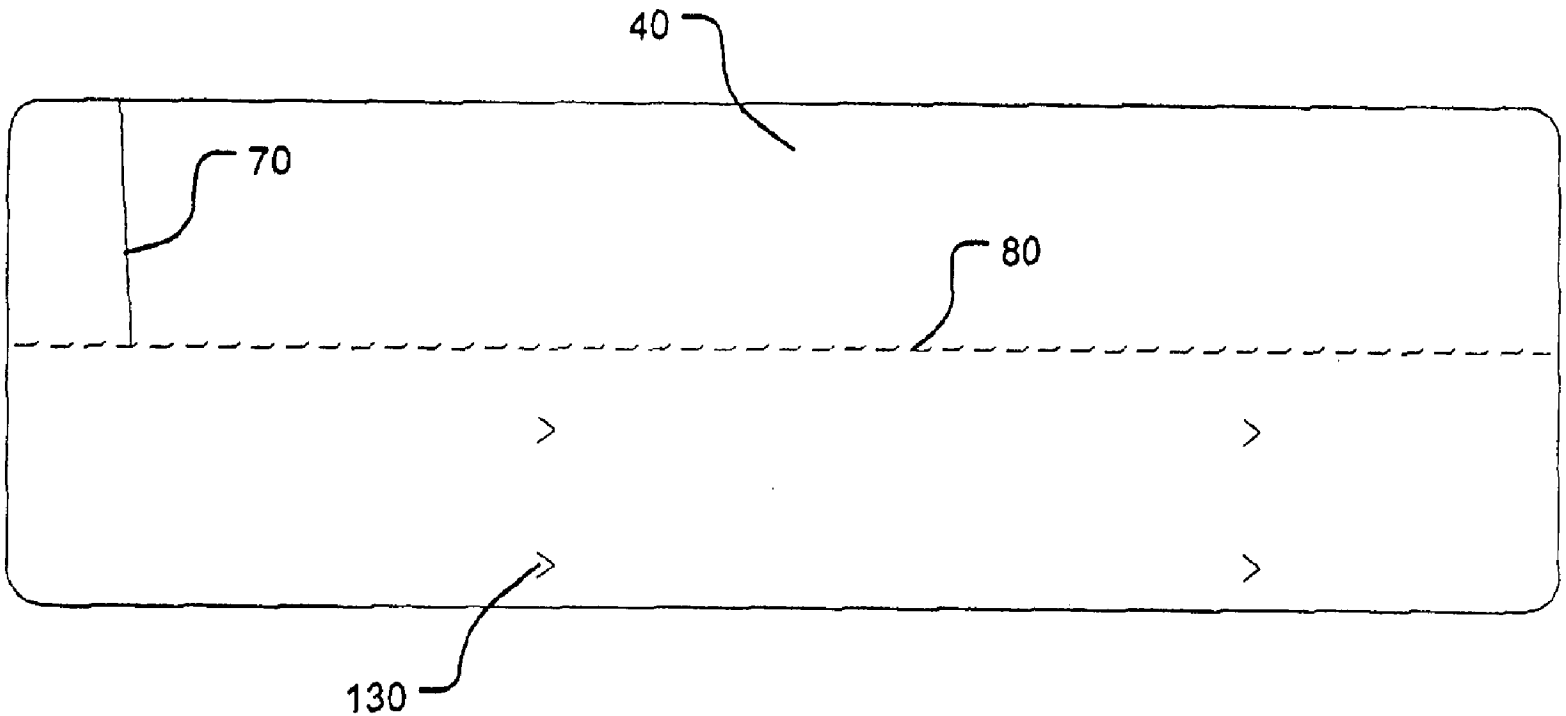
FIG. 7 illustrates an overlayer suitable for use with the label of FIG. 5.

Referring now also to FIG. 7, there is shown an overlayer 40 suitable for use with label 10 of FIG. 5. Layer 40 generally includes perforations 70, 80 and 130. Like base label 30, overlayer 40 may have a length and width somewhat larger than finished label 10. Layer 40 may have a length and width approximate that of label 10.

Figure 8:
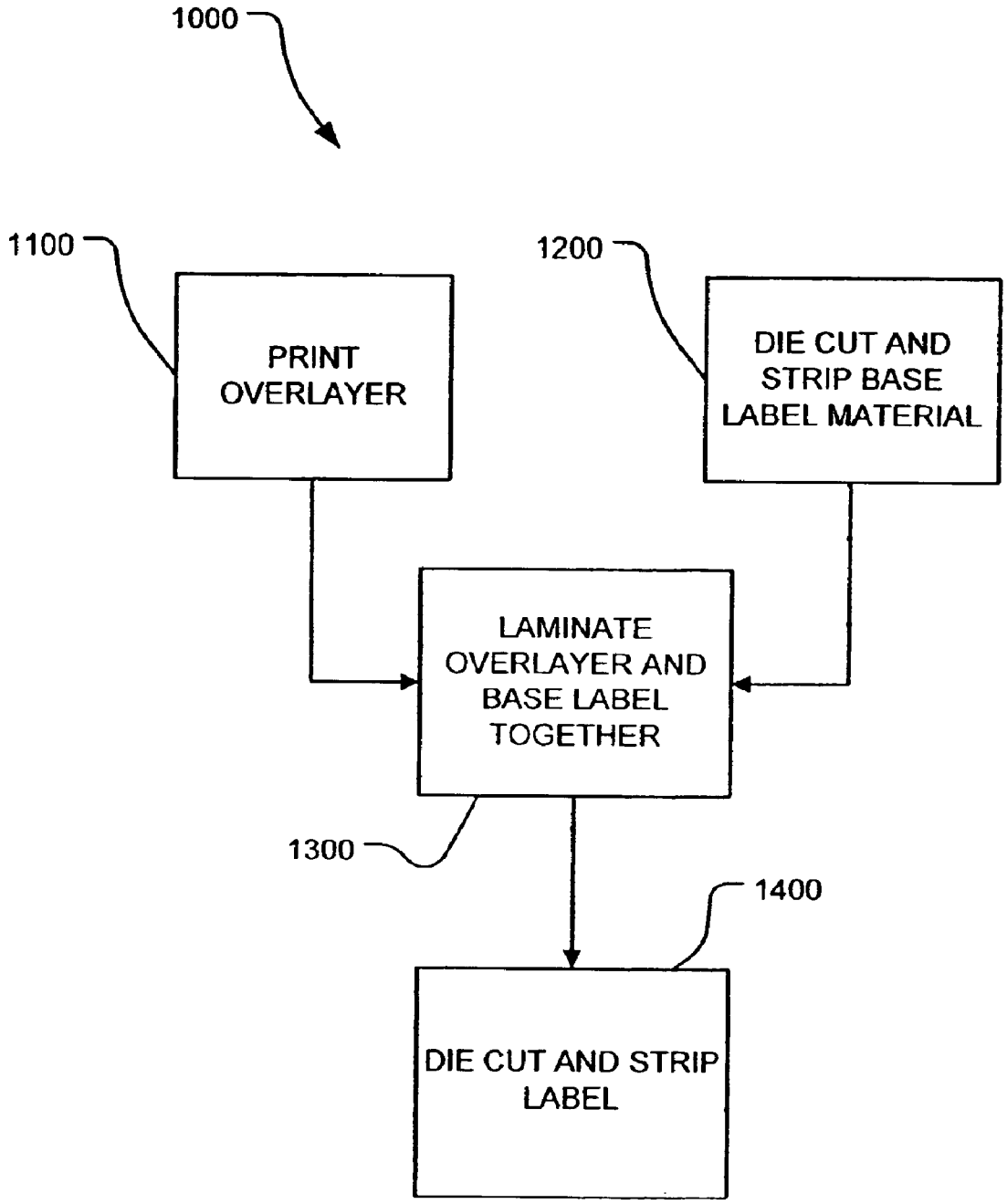
FIG. 8 illustrates a method for forming the label of FIG. 5 using the base label of FIG. 6 and overlayer of FIG. 7; and, FIGS. 9–11 illustrate alternative forms of the label, base label and overlayer of FIGS. 5–7, respectively.
Figure 9:
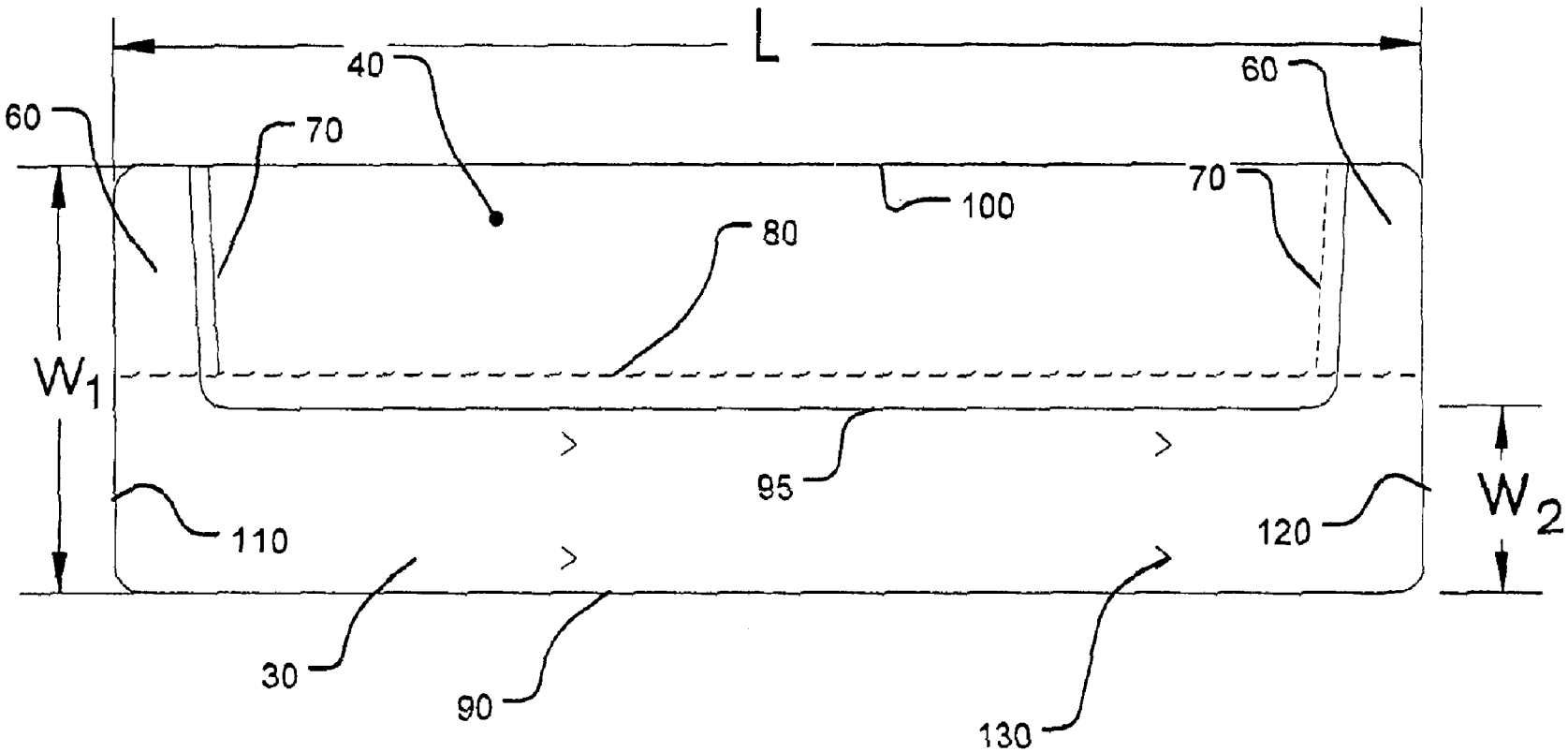
Figure 10:
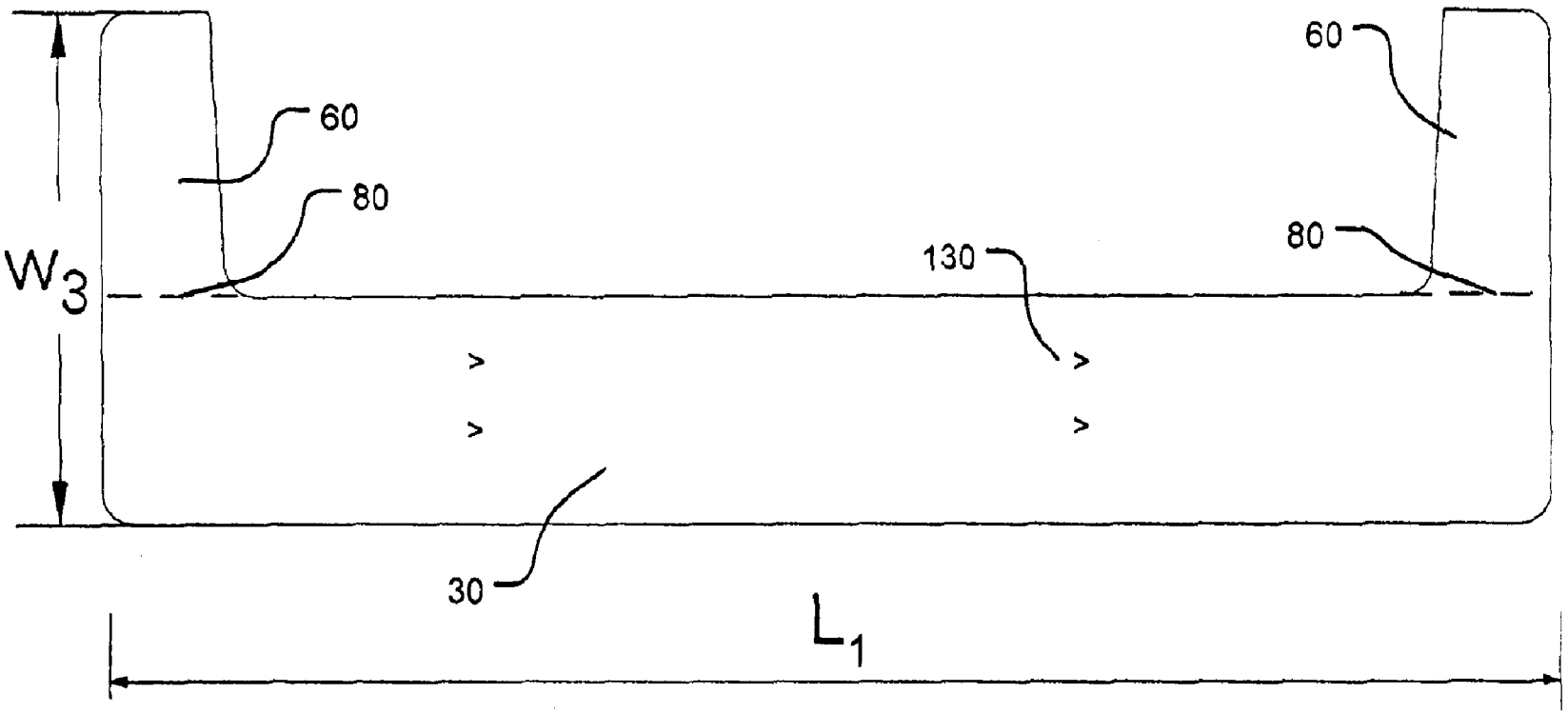
Figure 11:
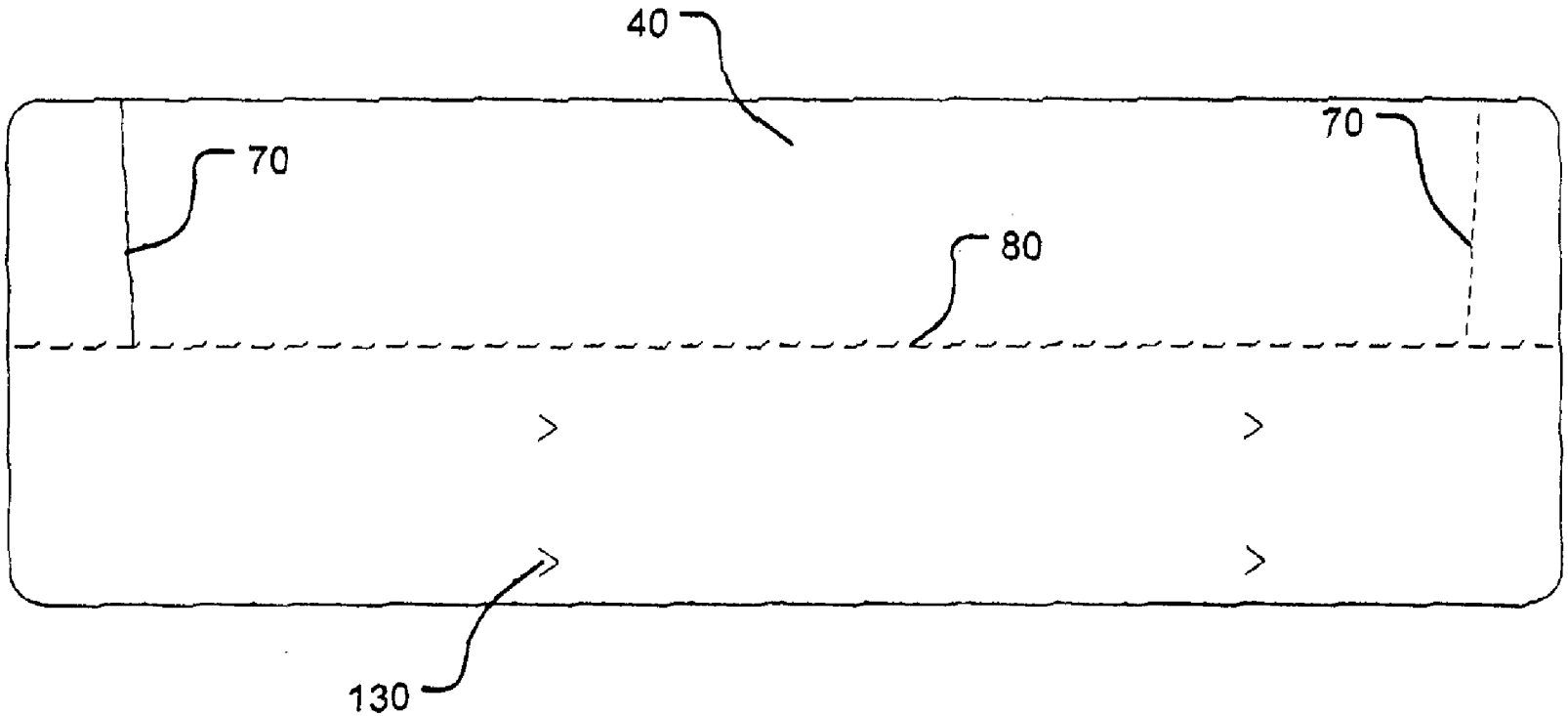

Referring now to FIG. 8, in conjunction with FIGS. 5, 6 and 7, there is shown a method 1000 for forming label 10 of FIGS. 4 and 5 using base label 30 of FIG. 6 and overlayer 40 of FIG. 7. Generally, method 1000 includes reverse printing 1100 indicia on a web of material for use as layer 40 (e.g. by any method well suited for use with layer 40 and label 10, such as flexographic, rotogravure, silk screening or other printing methods). Optionally, in order to prevent peel-back of layer 40 from base label 30 a UV non-shrinkable varnish may be applied to the underside of overlayer 40 prior to, or after, application of indicia (such as decorative inks. Optionally, base label 30 may also be printed, or printed in lieu of layer 40. Base label 30 may be die cut from a web of substrate, and excess material stripped 1200, so as to form base label 30 of FIG. 6, for example. Layer 40 may then be turned over, if it was reverse printed, and laminated together 1300 with die cut base label 30. Finally, the base label 30 and overlayer 40 combination may be die cut to provide perforations 70, 80, 130 and to trim the combination to width $W_1$ and length L, thereby producing labels 10 secured to a common web by a PSA of base label 30, for example.

According to an aspect of the present invention, label 10 may be constructed by flexographic or other suitable printing methods in a single pass, or multiple passes, as is conventionally understood.

According to an aspect of the present invention, a suitable material for preventing pull back of portions of layer 40 from label 30 during the process of shrinking of layer 40 during the application of label 10 to an object may be applied to portions of the overlayer 40 corresponding to portions 60 of base label 30, and/or at least one end 110, 120 of the label 10, such as a UV non-shrink varnish by way of non-limiting example. For example, layer 40 may be reverse printed and coated with a varnish. An adhesive for laminating layer 40 to base label 30 may be applied to either the varnish or base label, which adhesive is used to laminate label 30 and layer 40 together.

Further, adhesive deadener may be applied to PSA on an underside of base label 30 corresponding to one or more portions 60, so as to facilitate breakaway of portions 50 from an object that label 10 is affixed about.

Figure 2:
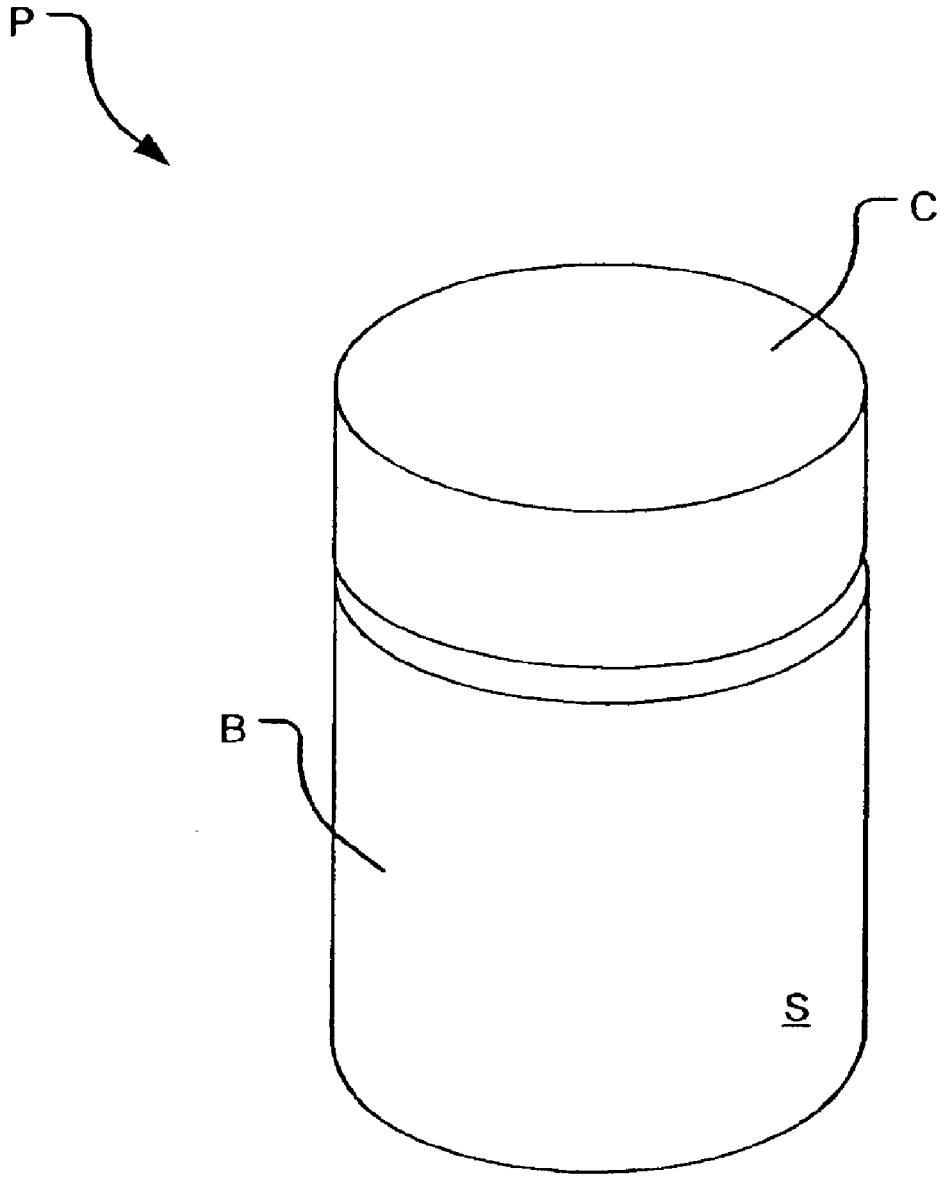
Figure 3:
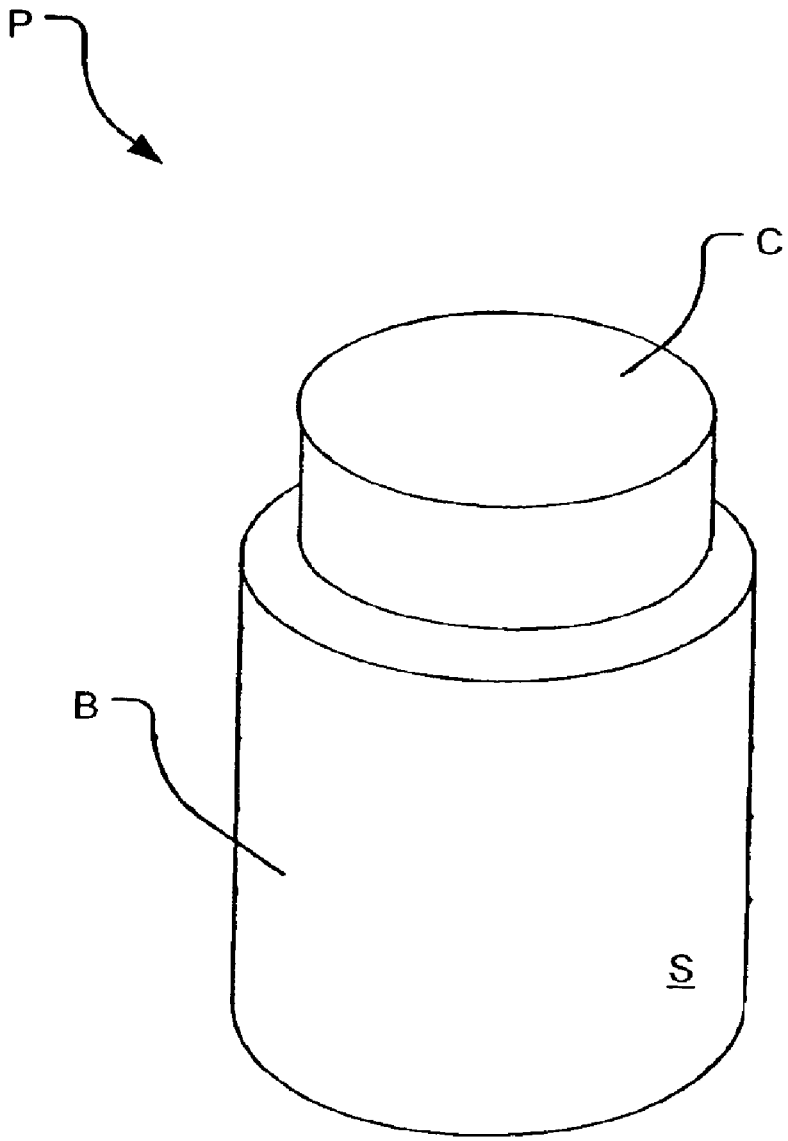

Such webs of labels 10 may be provided for application of labels 10 to objects, such as containers P (FIGS. 1–3). The PSA of label 10 may be used to secure the base label about a container P, such as by adherence directly to surface S (FIGS. 1–3) of body B (FIGS. 1–3) by way of non-limiting example only. Overlayers 40 of labels 10 may then be shrunk so as to at least partially envelop caps C (FIGS. 1–3) thereby providing tamper evidence and labeling for containers P (FIGS. 1–3).

As label 10 may be applied to objects in a conventional web manner, and label 10 includes "safety seal" operability, shrinkage of portions of layer 40 may be materially different from conventional sleeve and shrink operability as shrinkage may be designed to occur in primarily the web or machine direction of the web of labels as opposed to a transverse direction of the sleeve, for example.

This discussion represents a non-limiting example of the invention for purposes of explanation only. It will be apparent to those skilled in the art that various modifications and variations may be made in the apparatus and process of the present invention without departing from the spirit or scope of the invention. By way of non-limiting example, though two (2) portions 60 are illustrated in FIGS. 5 and 6, of course a single portion 60 may be utilized depending upon design criteria of label 10. Further, multiple portions 50 may be provided to define a removable portion of layer 40. It is intended that the present invention, and any patent therefore, cover such modifications and variations.

What is claimed is:

1. A unitary labeling apparatus for a container having a cap secured over an opening to an interior hollow, said apparatus comprising:

a non-shrinkable base label capable of being secured about a periphery of said container and to a portion of said cap; and, a shrinkable overlayer secured to said base label and capable of being shrunk about said periphery of said container and a periphery of said cap;

wherein, said unitary labeling apparatus is capable of evidencing accessing of said container interior hollow via removal of said cap once secured about said container.

2. The apparatus of claim 1, wherein said base label and overlayer each have a length approximate that of the periphery of said container.

3. The apparatus of claim 2, wherein corresponding portions of said base label and overlayer form a peel-tab for accessing said cap.

4. The apparatus of claim 1, wherein said container is a child-proof container.

5. The apparatus of claim 1, wherein said base label comprises a flexible substrate.

6. The apparatus of claim 5, wherein said flexible substrate comprises at least one of paper, polyvinyl chloride and polyethelene.

7. The apparatus of claim 1, further comprising a pressure sensitive adhesive on a surface of said base label.

8. The apparatus of claim 7, further comprising indicia on a surface of said base label opposite said pressure sensitive adhesive.

9. The apparatus of claim 8, further comprising indicia on said overlayer.

10. The apparatus of claim 6, wherein said overlayer comprises at least one of a shrinkable PVC, polyethylene, PETG, OPS, polypropylene, polyolefin, polystyrene and polyester.

11. The apparatus of claim 10, further comprising printed indicia on each of said base label and overlayer.

12. The apparatus of claim 1, further comprising perforations running along a majority of the longitudinal length of said labeling apparatus.

13. The apparatus of claim 12, further comprising perforations running laterally across at least a portion of said labeling apparatus.

14. The apparatus of claim 1, further comprising at least one perforation in said base label for facilitating at least partial destruction of said labeling apparatus responsively to attempted removal of said labeling apparatus from said container.

15. The apparatus of claim 1, further comprising at least one UV non-shrinkable varnish applied to at least a portion of said overlayer.

16. The apparatus of claim 1, further comprising an at least partially deadened pressure sensitive adhesive on at least a portion of said base label.

17. A method for making a unitary labeling apparatus for a container having a cap secured over an opening to an interior hollow, said method comprising:

printing indicia on at least one of a non-shrinkable base label capable of being secured about a periphery of said container and to a portion of said cap, and a shrinkable overlayer secured to said base label and capable of being shrunk about said periphery of said container and a periphery of said cap; and, securing said base label to said overlayer;

wherein, said unitary labeling apparatus is capable of evidencing accessing of said container interior hollow via removal of said cap once secured about said container.

18. The method of claim 17, further comprising applying a UV non-shrinkable varnish to at least one portion of said overlayer.

19. The method of claim 17, further comprising die cutting said base label and overlayer.

20. The method of claim 17, wherein said securing said base label to said overlayer comprises laminating said base label to said overlayer.

* * * * *